US009243487B2

(12) United States Patent
Geilikman et al.

(10) Patent No.: US 9,243,487 B2
(45) Date of Patent: Jan. 26, 2016

(54) ELECTROFRACTURING FORMATIONS

(71) Applicant: Shell Oil Company, Houston, TX (US)

(72) Inventors: Mikhail Boris Geilikman, Houston, TX (US); John Michael Karanikas, Houston, TX (US); Mohamad Fereydoon Khodaverdian, The Woodlands, TX (US); Ernesto Rafael Fonseca Ocampos, Houston, TX (US); Sau-Wai Wong, Rijswijk (NL)

(73) Assignee: Shell Oil Company, Houston, TX (US)

( * ) Notice: Subject to any disclaimer, the term of this patent is extended or adjusted under 35 U.S.C. 154(b) by 297 days.

(21) Appl. No.: 13/852,680

(22) Filed: Mar. 28, 2013

(65) Prior Publication Data

US 2013/0255936 A1 Oct. 3, 2013

Related U.S. Application Data

(60) Provisional application No. 61/617,221, filed on Mar. 29, 2011.

(51) Int. Cl.

| | |
|---|---|
| ***E21B 43/26*** | (2006.01) |
| ***E21B 43/267*** | (2006.01) |
| ***E21C 37/18*** | (2006.01) |

(52) U.S. Cl.

CPC ..... *E21B 43/26* (2013.01); *E21B 43/267* (2013.01); *E21C 37/18* (2013.01)

(58) Field of Classification Search

USPC ..... 166/248, 272.2

See application file for complete search history.

(56) References Cited

U.S. PATENT DOCUMENTS

| | | | | |
|---|---|---|---|---|
| 4,046,194 | A | 9/1977 | Cloud | |
| 4,084,638 | A * | 4/1978 | Whiting | 166/248 |
| 4,667,738 | A | 5/1987 | Codina | |
| 5,473,165 | A * | 12/1995 | Stinnett et al. | 250/492.21 |
| 6,199,634 | B1 * | 3/2001 | Selyakov | 166/248 |
| 7,131,498 | B2 | 11/2006 | Campo | 166/381 |
| 7,631,691 | B2 | 12/2009 | Symington et al. | 166/248 |
| 2007/0000662 | A1 | 1/2007 | Symington et al. | |
| 2008/0173443 | A1 * | 7/2008 | Symington et al. | 166/248 |
| 2008/0230219 | A1 | 9/2008 | Kaminsky | |
| 2010/0258265 | A1 * | 10/2010 | Karanikas et al. | 165/45 |
| 2011/0033238 | A1 * | 2/2011 | Riese | 405/53 |

OTHER PUBLICATIONS

Melton and Cross, Quarterly, Colorado School of Mines (Jul. 1967), 62, No. 3, 45-60.

B. S. Harper, "Nederhurt Niftier", The Southern African Institute of Mining and Metallurgy, Narrow Vein and Reef 2008.

PCT International Search Report, Application No. PCT/US2013/033961 dated Jun. 19, 2013.

* cited by examiner

*Primary Examiner* — Taras P Bemko

(57) ABSTRACT

A method is provided to produce hydrocarbons from a formation, the method includes the steps of: placing a pair of electrodes within a formation; applying differential voltages between pairs of electrodes wherein the voltage differences between the electrodes is greater than at least 10,000 volts; and producing hydrocarbons from the formation or an adjacent formation wherein the formation has an initial permeability of less than ten millidarcy. The invention also includes an apparatus effective to release pulses of electrical energy into the formation as this frequency and voltage at least until the formation has reached a point where the electrical potential arcs from one electrode to at least one other electrode.

18 Claims, 4 Drawing Sheets

ELECTROFRACTURING FORMATIONS

RELATED APPLICATONS

This application claims the benefit of U.S. Provisional Application No. 61/617,221, filed Mar. 29, 2012, the disclosure of which is incorporated by reference herein in its entirety.

FIELD OF THE INVENTION

The invention relates to a method of increasing hydrocarbon productivity from a relatively low permeability formation by application of pulses of high voltage between pairs of electrods within the formation and thereby removing mass from the formation.

BACKGROUND

Fracturing of rocks by passing pulses of current between electrodes within a formation is discussed, for example, by Melton and Cross, Quarterly, Colorado School of Mines (Jul. 1967), 62, No. 3, 45-60, ("Melton") which discusses passing short, high energy electrical pulses through Green River Oil Shale to create horizontal permeable paths for subsequent fire flooding to heat the oil shale and produce hydrocarbons by thermal cracking of kerogen. Field tests were disclosed wherein high voltage pulses of electricity created zones of increased permeability between wellbores that were up to 115 feet apart.

Hydraulic fracturing is typically utilized to enhance production from formations which have low permeabilities. The hydraulic fractures are propped open by proppants such as sand having specific distribution of sizes. By providing hydraulic fractures, a considerably larger surface area is provided for hydrocarbons to migrate to through the low permeability formation. Improvements to hydraulic fracturing technology has permitted profitable production of natural gas and light hydrocarbon liquids from formations previously thought to be impractical to produce. Although hydraulic fracturing has enabled economical production from many low permeability formations, hydraulic fractures cause increases in formation stress due to compression of the formation to create volume for the fractures. This increased stress results in reduction of formation permeability. Further, providing hydraulic fractures can be a relatively high portion of the total costs of drilling and completing a well and requires pumping into the formation and subsequently removing from the formation large volumes of water.

Novas Energy Services, located at Moscow, Kievskoe Highway, Business Center "Rumyantsevo", building "G", offers services for oil field production and injection wells that includes utilization of plasma-pulse action in the wells to improve the well drained zone permeability. It is claimed that this treatment increases oil flow rates into the well and injectivity from injection wells. Electrical pulses of three thousand to five thousand volts lasting from fifty to fifty three microseconds are applied releasing considerable amounts of energy creating shock waves. The resonance vibrations created in the productive stratum are said to make it possible to clean the existing filtration channels and create new filtration channels at distances of over fifteen hundred meters from the well being treated. The plasma pulses created by Novas Energy Services appear to be utilized to generate mechanical shock waves that are intended to open existing pores within the formation. Because the release of the electrical pulses within the wellbore are directed toward electrical grounds, the current density decreases rapidly with distance from the wellbore thus the mechanism of Novas Energy Services is not to remove mass from the formation by vaporization of mineral mass.

Electric rock breaking is discussed in B. S. Harper, "Nederburt Nimer", The Southern African Institute of Mining and Metallurgy, Narrow Vein and Reef 2008. Electric plasma arcs are considered for the purpose of removing rocks for following small veins of gold ore. Placement of electrodes within hydraulic fractures in a formation is known, for example, from U.S. Pat. No. 7,631,691. In this patent, electrical voltage is applied across the fracture to provide heat to the formation for pyrolysis of kerogen within the formation.

SUMMARY OF THE INVENTION

A method is provided to produce hydrocarbons from a formation, the method comprising the steps of: placing a pair of electrodes within a formation; applying pulses of differential voltages between pairs of electrodes wherein the voltage differences between the electrodes is greater than at least 10,000 volts or in other embodiments, greater than 100,000 volts; and producing hydrocarbons from the formation or an adjacent formation wherein the formation has an initial permeability of less than ten millidarcy. The voltage could be applied in a plurality of pulses of, for example, less than about 500 nanoseconds in duration. Electrodes could be, for example, 10 meters to 300 meters apart. This method provides permeability by removal of mass which also results in reduction of formation stress. The method can be useful in formations having low initial permeability, such as in the range of 0.00001 to 10.0 millidarcy. Produced hydrocarbons could be essentially natural gas, light tight oil, or combinations thereof. The high voltage pulses may cause plasma discharges with can follow random paths between electrodes. In one embodiment of the present invention, the electrodes may be formed by placing electrically conducting proppants in hydraulic fractures and to provide a large area from which the pluses of electrical power may be emitted. Alternating fractures, from, for example, a horizontal wellbore, could be equipped to be oppositely charged electrodes. Mass could then be removed from the formation between the two electrodes.

DETAILED DESCRIPTION

The present invention creates permeability in a formation by multiple mechanisms. Physical removal of rock mass by decomposition or vaporization of a portion of the rock by a plasma arc created by pulses of differential voltage between electrodes is one mechanism. Decomposition of rocks may be, for example, decomposition of dolomite or decomposition of calcite. Decomposition of dolomite can occur, for example, at a temperature of at least 530° C. leading to 21% loss of solid mass of dolomite according to the reaction:

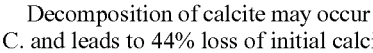

$$CaMg(CO_3)_2 \rightarrow MgO + CaCO_3 + CO_2$$

Decomposition of calcite may occur at about 900 to 1000° C. and leads to 44% loss of initial calcite mass:

For each pair of positions of electrodes rock will be removed in essentially a path between the positions of the electrodes. Because formations are not homogeneous, the path of removal of rock will not be a straight line but along paths of least resistance between the electrodes. In a coal or oil shale formation, the presence of carbon will result in a first arc forming a more conductive path and further arcs tend to follow that path. In formations that do not contain high contents of hydrocarbons, such as tight gas formations, the result is different. The arcs tend to be transmitted along the surface of mineral solids. When the arc causes such mineral solids to be removed, rather than continuing to follow the similar path, a different path will tend to become the path of least electrical resistance and therefore the electrical arcs will tend to remove rock mass along a line between the electrodes but does so in multiple paths.

Generally, removal of mass from the formation will reduce the stress on the formation and increase permeability and porosity of the formation. The extent to which formation stress is reduced and permeability and porosity are increased will depend on how much stress from overburden is transferred to other places. This effect is referred to as "arching". In one extreme, for removal of significant mass from a small region, with a formation that is not ductile and with very low compressibility, stress can be significantly reduced because the formation does not compress inward toward the lost mass. The opposite extreme would be a formation that is very poorly consolidated. Removal of mass from a poorly consolidated formation with a poorly consolidated overburden will have very little effect on stress, permeability or porosity because there will be little, if any, arching. The present invention preferably removes enough mass to result in a decrease of formation stress of at least five percent of initial stress.

Figure 1:
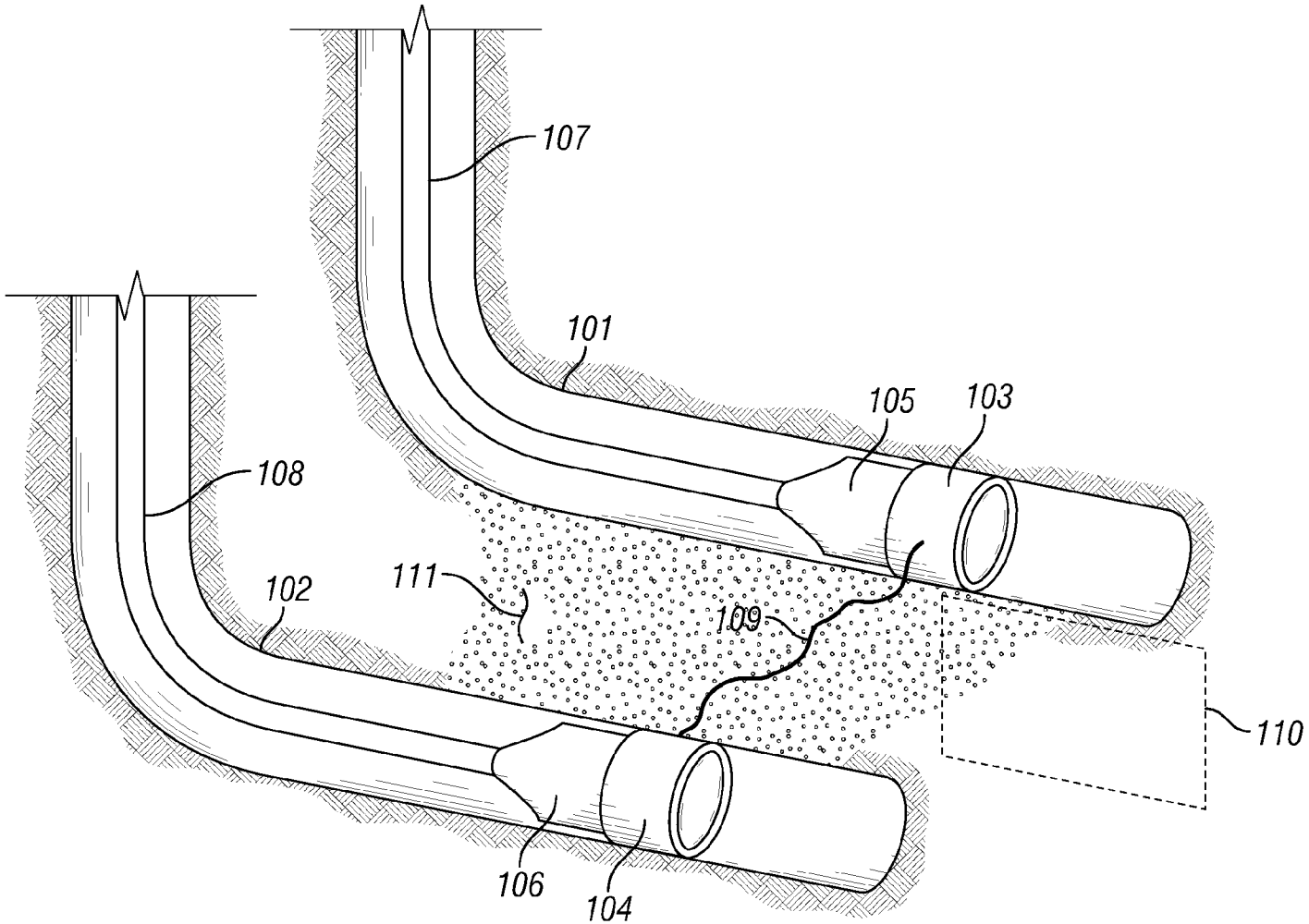
FIG. 1 is a schematic drawing showing placement of electrodes in parallel horizontal wellbores for the practice of the present invention.

Referring now to FIG. 1, two parallel horizontal wellbores are shown 101 and 102, each containing an electrode, 103 and 104, and a plasma pulse generation system 105 and 106. The wellbores can be open hole completions, or cased completions. If the wellbores are cased within the formation for which the electrofractures are to be created, the wellbores may be cemented with electrically conductive cement, or may be expanded casings where in the casing is expanded to form contact with the formation. When the wellbores are cased, the casings may be electrically isolated from casings and tubulars outside of the formation which is to be subjected to the process of the present invention. In another embodiment, the casing could comprise segments of electrically conductive casing connected by segments of casing that are not electrically conductive. Casing segments that are not electrically conductive could be, for example, fiberglass segments that are of sufficient length so that the plasma pulse does not arc past the non-conductive segment. Electrodes 103 and 104 may have a significant contact area with either the wellbore or the casing by for example, being pressed outward such as a packer assembly or expandable mandrel such as the mandrel taught in U.S. Pat. No. 7,131,498, to reduce electrical resistance in the outward radial direction. Providing good electrical contact between the electrode and the wellbore or casing will reduce the voltages required to cause formation minerals to conduct electrical current between the two electrodes. In an advantageous embodiment of the present invention, the wellbore could be an open hole completion.

The electrodes could be provided with an electrically isolating section on each end of the electrode, with the electrically isolating section including an elastomeric expandable packing so that loss of electrical current to wellbore fluids from the electrodes will be minimized.

Plasma pulse generation systems 105 and 106 may be located in close proximity to the electrodes to minimize power loss between the two elements, but with sufficiently low resistance electrical connections between the two, the plasma pulse generation system could be remotely positioned. Electrical lead-ins 107 and 108 provide electrical power from a power supply to the plasma pulse generation systems 105 and 106, and also, in the embodiment shown, provide a means for moving the electrodes within the wellbore. The electrical lead-ins may also support conduits for control signals to the system.

Plasma pulse generation systems may be similar to the system disclosed by Melton or the systems used by Novas Energy Services. Generally, these systems capture high voltage charges in a bank of storage capacitors and then release the charges via calibrated conductors to electrodes in bursts of short duration.

When sufficiently high voltage electrical pulses are provided between the electrodes 103 and 104, a plasma arc 109 is formed between the electrodes 103 and 104. The electrical arc will travel along mineral surfaces in a path of least electrical resistance between the two electrodes. Along this path, vapors will be generated by vaporization of water and decomposition and vaporization of mineral components from the formation. In particular, carbon dioxide may form from carbonates that are present in the minerals of the formation. Hydrocarbons may also decompose forming carbon and hydrogen, along with hydrogen sulfide, carbon dioxide and other products depending on the composition of the hydrocarbons. With sufficiently large amounts of hydrocarbons present, residual carbon may form a path of less electrical resistance, and cause subsequent arcs to pass over the same path. With less hydrocarbons, or carbon, present, the after the arcs remove some mineral material from an original path of least electrical resistance, the resistance of that path will tend to increase rather than decrease. Therefore instead of one path becoming more pronounced, multiple paths will be created in succession, each path essentially along a line between the electrodes, but meandering around that line as the compositions and void volumes, and therefore the electrical resistance, varies.

Effective permeability of the formation is not only increased by the removal of mass, but the rapid vaporization of water and/or carbon dioxide from the carbonates or hydrocarbons, causes localized high pore pressures that can cause micro fractures around the path of the plasma.

Parallel wellbores that are horizontal within the formation to which the electrofractures are to be created could be utilized to provide placement of electrodes according to the present invention. Alternatively, the wellbores could be vertical or positioned so they are not parallel. The present invention could be used to create electrofractures between electrodes at one set of positions within a pair of wellbores, and then the electrodes moved and electro fractures created between two different positions. Different lines of electrofractured formation could be provided in close enough proximity to the adjacent lines of electrofractured formation so that the formation would contain essentially a plane of electrofractured formation between the two wellbores.

In one embodiment of the present invention, paths of electrofractures that connect the positions of the electrodes may be essentially perpendicular to the plane of natural fractures, 110. Although the plane of natural fractures are not always perpendicular to the direction of minimal stress, the natural fractures are typically in the general direction of perpendicular to the direction of minimal stress. Any hydraulic fractures placed in the formation would also tend to prorogate in a plane perpendicular to the direction of minimal stress. Electrofractures placed essentially perpendicular to the direction of minimal stress would therefore tend then connect with more natural fractures and hydraulic fractures and provide a more connected fracture system for flow of hydrocarbons to wellbores. The lines of electrofractures that connect the positions of the electrodes may be therefore advantageously placed essentially parallel to the direction of minimum stress in the formation. Alternatively, if the plane of natural fractures is know, the lines of electrofractures that connect the positions of the electrodes may be therefore advantageously placed essentially parallel to the direction of such natural fractures.

The formation 111 within which the electrofractures are provided according to the present invention may be a hydrocarbon containing formation. After formation of electrofractures, hydrocarbons may be produced from the hydrocarbon containing formation.

The present invention may be applicable to formations known as tight gas formations. Tight gas formations may have porosities of between two and ten percent, as opposed to most hydrocarbon reservoir formations which have 20 to 35 percent porosity. The permeabilities of tight gas reservoirs may be in the range of 0.00001 to 0.001 millidarcys. Hydrocarbons have in the past generally only been economically produced from these formations if many hydraulic fractures are provided to increase flow of hydrocarbons to production wellbores. A detrimental aspect of providing hydraulic fractures is that providing these hydraulic fractures compresses the minerals in the formation, causing increased stress. This increase in stress has a detrimental effect on permeability. The present invention, by removing mass of minerals, reduces the stress on the formation, which tends to open natural fractures and increase permeability. After provision of electrofractures in the formation, effective permeability of a formation may be increased by between 10 and 10,000 percent, where the "effective permeability is defined as the average permeability in the volume between the electrodes, where the volume between the electrodes is defined as the volume within a cylinder having a diameter equal to the length of the electrodes, around a line connecting the centers of the electrodes.

After subjecting the formation to plasma energy, optionally as plasma pulses, for a sufficient time to remove, for example, a fraction between $10^{-6}$ and $10^{-4}$ of the mineral mass from the formation between the electrodes, where the mass between the electrodes is defined as the mass within a cylinder having a diameter equal to the length of the electrodes, around a line connecting the centers of the electrodes.

After electrofractures are provided in the formation, and electrodes are recovered from the wellbores, hydrocarbons within the formation may be produced using the wellbores are production wells. The hydrocarbons may be natural gas.

Figure 2:
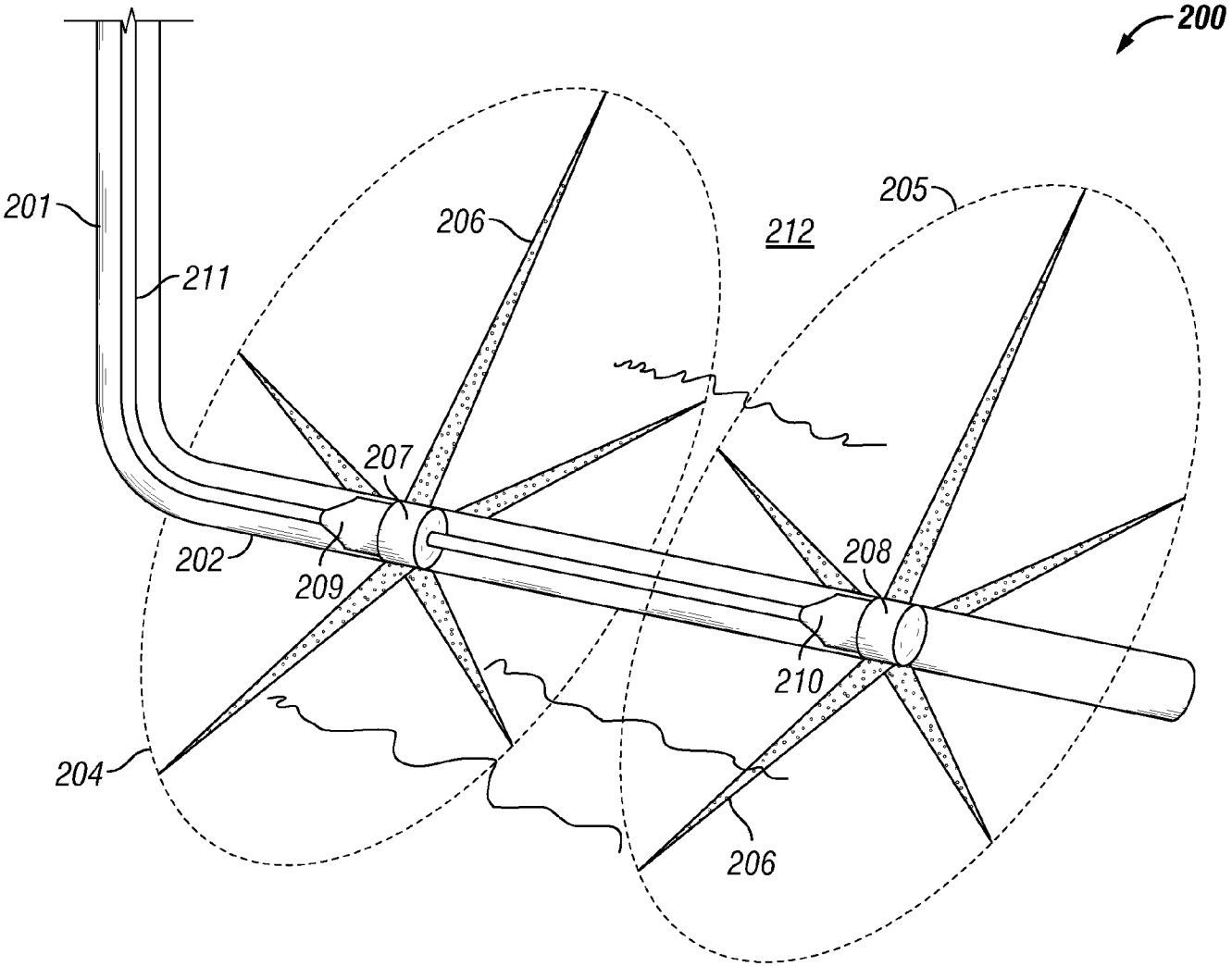
FIG. 2 is a schematic drawing of two parallel fractures propped with conductive proppant useful as electrodes for the practice of the present invention.

Referring now to FIG. 2, a wellbore 201 is shown with a horizontal section 202 within a formation 200 with two hydraulic fractures, 204 and 205, the hydraulic fractures propped with electrically conductive proppant 206. The wellbore is provided essentially in the direction of minimal stress in the formation, so that the hydraulic fractures will tend to be perpendicular to the horizontal wellbore. A pair of electrical power sources 207 and 208 in the wellbores are aligned with the two hydraulic fractures and electrically connected to the electrically conductive proppant within the hydraulic fractures. Plasma pulse generation systems 209 and 210 are located within the wellbores in close proximity to the electrodes. Electrical lead-in 211 provides electrical power from a power supply to the plasma pulse generation systems 209 and 210, and may also provide a means for moving the electrodes within the wellbore.

Electrical pulses are conducted from the electrical power sources through the proppant to provide an electrode that essentially fills the hydraulic fracture 204 and 205. Because electrical resistance within the fracture is considerably less than electrical resistance within the formation itself, a high voltage may be applied to the large area of the fracture. Formation between the two electrodes, 212, may be subjected to plasma pulse transmissions which vaporize some mineral components within the formation.

After subjecting the formation to plasma pulse energy for a time to remove, for example, a fraction between $10^{-6}$ and $10^{-4}$ of the mineral mass from the formation between the electrodes (as defined above). The power sources may be relocated to a different location in the wellbore, preferably adjacent to another set of adjacent fractures filled with electrically conductive proppant, and the process repeated. After the fractures within the formation are subjected to electrical pulses, the wellbore could be converted to a hydrocarbon production well, and hydrocarbons could be produced from the formation.

Rather than the embodiment of FIG. 2 being implemented from horizontal wellbores, fractures could also be provided from vertical wells.

Figure 3:
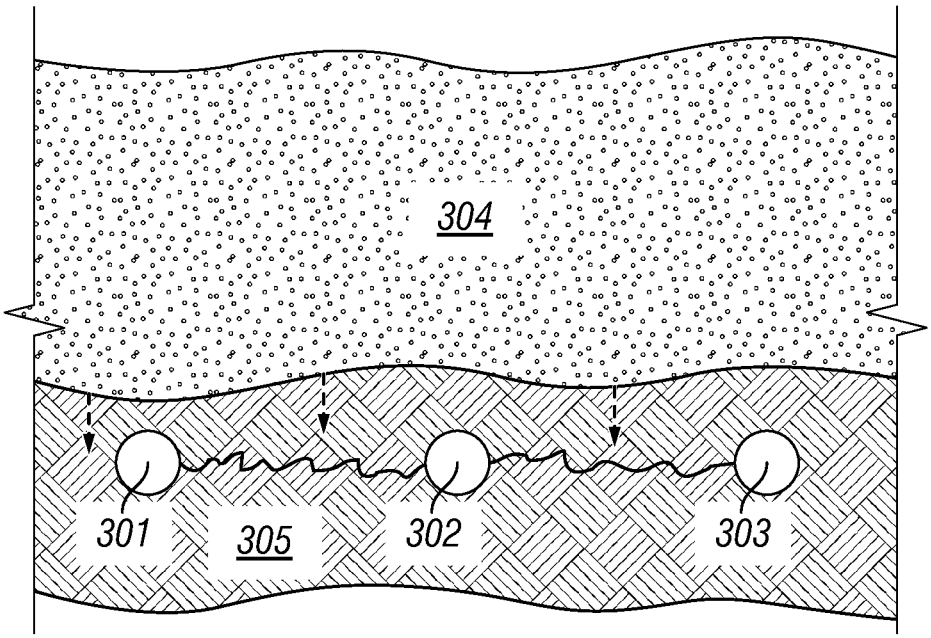
FIG. 3 is a schematic drawing of horizontal wellbores below a hydrocarbon containing formation where the present invention is used to create fractures in the hydrocarbon containing formation.

Referring now to FIG. 3, a vertical section is shown with horizontal wells 301, 302 and 303 perpendicular to the plane of the view. The horizontal wells are below a formation from which hydrocarbons are to be produced, 304, in a formation underlying the formation from which hydrocarbons are to be produced, 305. Electrical pulses may be provided according to the present invention between the horizontal wellbores resulting in removal of mass from the formation underlying the formation from which hydrocarbons are to be produced. Removal of this mass results in reduction of vertical stress from the formation from which hydrocarbons are to be produced. This reduction of stress results in increased permeability due to opening of natural fractures by stress relief and by tensile failure due to subsidence. Subsequent to application of the electrical pulses, Hydrocarbons may be produced from the formation 304.

Figure 4:
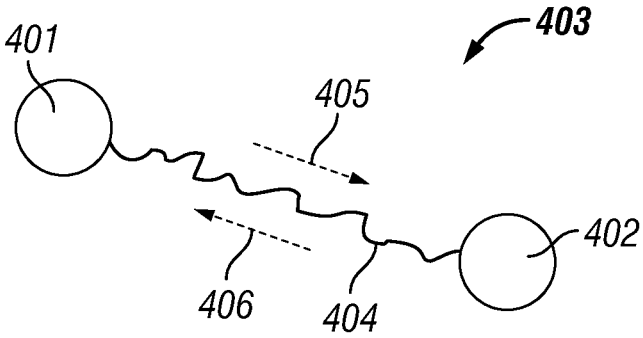
FIG. 4 is a schematic drawing of two parallel wellbores wherein the present invention is utilized to create slippage between two planes in a formation.

Referring now to FIG. 4, two wellbores are shown, 401 and 492, the wellbores being horizontal and perpendicular to the view. The horizontal wellbores are shown in at different depths, and perpendicular to the direction of the maximum formation stress, shown as 403. After application of electrical pulses between the two wellbores according to the present invention, a region of reduced mass exists between the two wellbores, 404. Because of the formation stress 403, the formation will tend to slip along the direction of the reduced formation mass along directions 405 and 406. .

Figure 5:
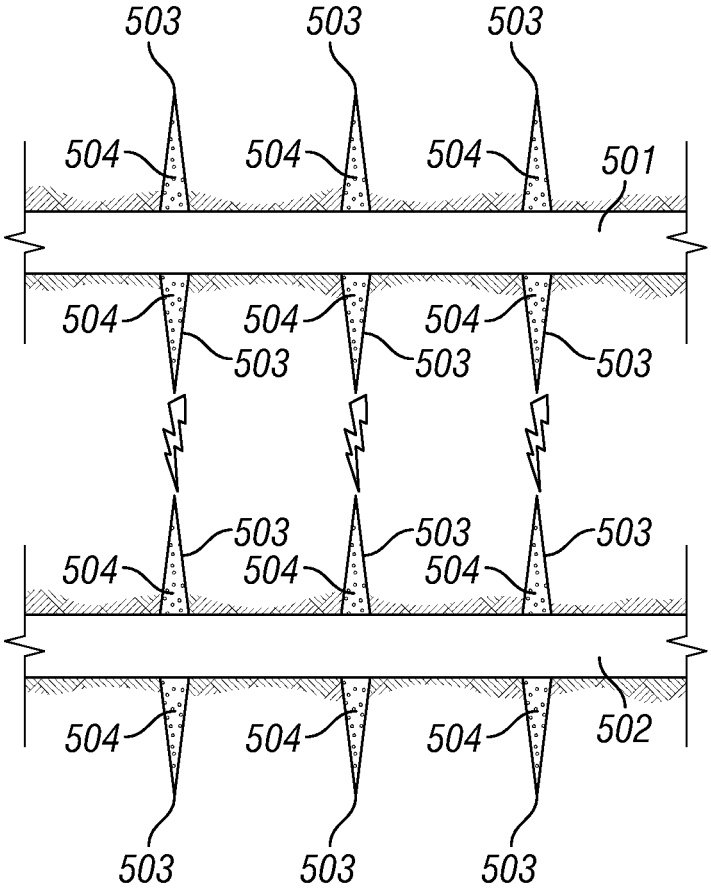
FIG. 5 is a schematic drawing of an alternative embodiment of the present invention.

Referring now to FIG. 5, an embodiment, wherein electrofractures of the present invention are used to extend hydraulic fractures to increase the total fracture size, and to remove mass from the formation. Horizontal reduction wells 501 and 502 are shown with fractures 503 filled with electrically conductive proppant 504. Two wells are shown, but a matrix or line of essentially parallel wells could be provided. Electrofractures are provided connecting the tips of the fractures with electrofratures 506. An advantage of this embodiment is that it provides a mechanism to extend hydraulic fracturing while minimizing water consumption. Electrofractures may also more easily advance from an electrically charged tip due to the concentration of charge and current at such locations.

What is claimed is:

1. A method to produce hydrocarbons from a formation, the method comprising the steps of:

placing a pair of electrodes within a formation;

applying differential voltages between pairs of electrodes wherein the voltage differences between the electrodes is greater than at least 10,000 volts; and producing hydrocarbons from the formation or an adjacent formation wherein the formation has an initial permeability of less than ten millidarcy, and wherein as a result of the application of the differential voltage, effective permeability of a formation is increased by between 10 and 10,000 percent, where the effective permeability is defined as an average permeability in a volume between the electrodes, where the volume between the electrodes is defined as the volume within a cylinder having a diameter equal to the length of the electrodes, around a line connecting the centers of the electrodes.

2. The method of claim 1 wherein the differential voltages between the electrodes causes at least a portion of the formation between the electrodes to vaporize.

3. The method of claim 1 wherein the electrodes are moved to different positions within two wellbores and pulses of differential voltages between the pairs of electrodes are repeated.

4. The method of claim 3 wherein the two wellbores are essentially parallel.

5. The method of claim 4 wherein the two wellbores are separated by a distance of between 30 and 90 meters.

6. The method of claim 3 wherein at least a section of both of the wellbores is essentially horizontal within the formation.

7. The method of claim 3 wherein a line between the two electrodes is perpendicular to a plane of natural fractures within the formation.

8. The method of claim 3 wherein a line between the two electrodes is in a direction of the minimum stress within the formation.

9. The method of claim 1 wherein between $10^{-6}$ and $10^{-4}$ of the mineral mass is removed from the formation between the electrodes, where the mass between the electrodes is defined as the mass within a cylinder having a diameter equal to the length of the electrodes, around a line connecting the centers of the electrodes.

10. The method of claim 1 wherein the formation, prior to application of the pulses of differential voltage has a permeability of between 0.00001 millidarcys and 0.001 millidarcys.

11. The method of claim 1 wherein the electrodes comprise electrically conductive propants within hydraulically formed fractures.

12. The method of claim 11 wherein the hydraulically formed fractures extend from different positions along a horizontal well.

13. The method of claim 11 wherein the hydraulically formed fractures extend from different wellbores.

14. The method of claim 11 wherein the hydraulic fractures are parallel.

15. The method of claim 11 wherein the hydraulic fractures are located in essentially the same vertical plane.

16. The method of claim 1 wherein the voltage differences between the electrodes is greater than at least 100,000 volts.

17. The method of claim 1 wherein the differential voltages are applied in a plurality of pulses that are less than 500 nanoseconds in duration.

18. The method of claim 1 wherein the hydrocarbons produced consist essentially of natural gas.

* * * * *